US010591867B2

(12) United States Patent
Iwai et al.

(10) Patent No.: US 10,591,867 B2
(45) Date of Patent: Mar. 17, 2020

(54) IMAGE FORMING APPARATUS WITH CLEANING MECHANISM FOR LED PRINT HEAD HAVING LIGHT EMITTING ELEMENTS

(71) Applicant: CANON KABUSHIKI KAISHA, Tokyo (JP)

(72) Inventors: Hitoshi Iwai, Abiko (JP); Shinichiro Hosoi, Tokyo (JP); Takehiro Ishidate, Tokyo (JP)

( * ) Notice: Subject to any disclaimer, the term of this patent is extended or adjusted under 35 U.S.C. 154(b) by 0 days.

(21) Appl. No.: 15/706,317

(22) Filed: Sep. 15, 2017

(65) Prior Publication Data

US 2018/0095405 A1 Apr. 5, 2018

(30) Foreign Application Priority Data

Oct. 4, 2016 (JP) ..... 2016-196480

(51) Int. Cl.
*G03G 15/04* (2006.01)
*G03G 15/32* (2006.01)
(Continued)

(52) U.S. Cl.
CPC ..... *G03G 21/169* (2013.01); *G03G 15/04054* (2013.01); *G03G 21/1633* (2013.01); *G03G 21/1666* (2013.01); *G03G 15/326* (2013.01); *G03G 21/00* (2013.01); *G03G 2215/0409* (2013.01); *G03G 2221/169* (2013.01); *G03G 2221/1654* (2013.01)

(58) Field of Classification Search
CPC ..... G03G 21/1666
See application file for complete search history.

(56) References Cited

U.S. PATENT DOCUMENTS 6,829,002 B2 12/2004 Iwai ..... 347/263
8,269,812 B2 9/2012 Morimoto ..... 347/257
(Continued)

FOREIGN PATENT DOCUMENTS

JP H07-302007 11/1995
JP H07-314779 12/1995
(Continued)

OTHER PUBLICATIONS

U.S. Appl. No. 15/702,219, filed Sep. 12, 2017.
(Continued)

*Primary Examiner* — Victor Verbitsky

(57) ABSTRACT

An image forming apparatus includes: an LED print head exposing a photosensitive drum with light; a door arranged on one end side of the LED print head; a support portion for the LED print head operating in conjunction with opening and closing movements of the door, positioning the LED print head at a first position for exposing the photosensitive drum when the door is closed, and positioning the LED print head at a second position more apart from the photosensitive drum than the first position when the door is open; and a guide portion formed on the door and guiding a cleaning member to the LED print head, the guide portion having a first inclined surface which is lowered toward the LED print head so that the cleaning member is continuously held in contact with the LED print head under a state in which the door is open.

16 Claims, 8 Drawing Sheets

(INNER DOOR IS OPEN)

(51) Int. Cl.
*G03G 21/00* (2006.01)
*G03G 21/16* (2006.01)

(56) References Cited

U.S. PATENT DOCUMENTS

| | | | | |
|---|---|---|---|---|
| 8,810,622 | B2 | 8/2014 | Mamiya et al. | 347/242 |
| 8,917,305 | B2 | 12/2014 | Nakahata et al. | 347/244 |
| 8,947,478 | B2 | 2/2015 | Ishidate et al. | 347/137 |
| 9,086,645 | B2 | 7/2015 | Otoguro et al. | G02B 26/125 |
| 9,195,063 | B2 | 11/2015 | Ishidate et al. | G03G 15/04072 |
| 9,316,992 | B2 | 4/2016 | Ishidate et al. | G03G 21/1666 |
| 9,400,444 | B2 | 7/2016 | Sato et al. | G02B 26/121 |
| 9,517,638 | B2 | 12/2016 | Otoguro et al. | G03G 15/04072 |
| 9,720,207 | B2 | 8/2017 | Otoguro et al. | G03G 2215/013 |
| 9,772,577 | B2 | 9/2017 | Ishidate et al. | G03G 15/043 |
| 2004/0240905 | A1* | 12/2004 | Yamazaki | H04N 1/00519 399/98 |
| 2009/0087210 | A1* | 4/2009 | Terao | G03G 15/011 399/99 |
| 2009/0245850 | A1* | 10/2009 | Kawai | G03G 21/1666 399/98 |
| 2010/0245525 | A1 | 9/2010 | Morimoto et al. | 347/224 |
| 2016/0347083 | A1 | 12/2016 | Ishidate | B41J 2/471 |
| 2017/0010558 | A1 | 1/2017 | Ishidate et al. | B41J 2/47 |
| 2017/0064108 | A1 | 3/2017 | Mamiya et al. | H04N 1/19 |
| 2017/0371292 | A1* | 12/2017 | Narita | G03G 15/0409 |

FOREIGN PATENT DOCUMENTS

| | | |
|---|---|---|
| JP | 2010-230954 | 10/2010 |
| JP | 2015-099179 | 5/2015 |

OTHER PUBLICATIONS

U.S. Appl. No. 15/720,644, filed Sep. 29, 2017.
Extended European Search Report dated Feb. 13, 2018, in counterpart European Application No. 17192543.1.

* cited by examiner (INNER DOOR IS CLOSED)

(INNER DOOR IS OPEN)

(INNER DOOR IS CLOSED)

(INNER DOOR IS OPEN)

IMAGE FORMING APPARATUS WITH CLEANING MECHANISM FOR LED PRINT HEAD HAVING LIGHT EMITTING ELEMENTS

BACKGROUND OF THE INVENTION

Field of the Invention

The present invention relates to an image forming apparatus of an electrophotographic type, such as a copying machine, a printer, or a facsimile, to which a light-emitting element array is mounted.

Description of the Related Art

An image forming apparatus of an electrophotographic type such as a printer or a digital copying machine may include an LED print head serving as a light source configured to expose a photosensitive drum with light. The LED print head is an exposure light source including a predetermined number of LEDs arrayed in a direction intersecting a rotation direction of the photosensitive drum. That is, the predetermined number of LEDs are arranged at different positions in the direction intersecting the rotation direction of the photosensitive drum, and each LED forms one pixel in this direction. The LED print head occupies a smaller volume in the apparatus as compared to a laser scanner unit (hereinafter referred to as "LSU") using a rotary polygon mirror, and a motor is not required in the LED print head. Therefore, the image forming apparatus using the LED print head can attain an effect of downsizing and noise reduction as compared to the image forming apparatus using the LSU.

The LED print head needs to be arranged closer to a surface of the photosensitive drum as compared to the LSU. Therefore, toner is liable to adhere to the LED print head. When the toner adheres to a surface of the LED print head, an exposure light amount from the portion of the LED print head, to which the toner adheres, to the photosensitive drum is reduced. Therefore, occurrence of image defects such as density unevenness is concerned. Consequently, it is necessary to regularly clean a head surface of the LED print head with use of a cleaning member. For example, in Japanese Patent Application Laid-Open No. 2010-230954, there is disclosed a cleaning member including a cleaning pad configured to rub a light exit surface of an LED print head. On a surface of the cleaning member on a photosensitive drum side, there is provided a protection member configured to rub a surface of the photosensitive drum. The cleaning member slides in a longitudinal direction of the LED print head under a state in which the cleaning member is sandwiched between the photosensitive drum and the LED print head. With this action, the cleaning member is capable of cleaning the light exit surface along the longitudinal direction of the LED print head without being separated from the light exit surface of the LED print head.

With regard to the cleaning member of the image forming apparatus disclosed in Japanese Patent Application Laid-Open No. 2010-230954, even when a member which is less liable to damage the surface of the photosensitive drum is used for the protection member, the surface of the photosensitive member may be damaged by rubbing. In particular, when an adhering matter is present on the protection member, the adhering matter may damage the surface of the photosensitive drum.

When the photosensitive drum is to be replaced, the photosensitive drum is moved along the longitudinal direction of the LED print head. As in the image forming apparatus disclosed in Japanese Patent Application Laid-Open No. 2010-230954, when the LED print head and the surface of the photosensitive drum are arranged close to each other, the LED print head may be brought into contact with the surface of the photosensitive drum to damage the surface of the photosensitive drum. Therefore, when the photosensitive drum is to be replaced, it is necessary to separate the photosensitive drum and the LED print head from each other. In such a case, the photosensitive drum and the LED print head are separated by a large distance. For such an image forming apparatus, it is not practical to clean the LED print head with use of the cleaning member disclosed in Japanese Patent Application Laid-Open No. 2010-230954.

The present invention has been made under such a circumstance, and has an object to reliably clean an LED print head with use of a cleaning member without providing a guide portion for the cleaning member to the LED print head.

SUMMARY OF THE INVENTION

The present invention has the following configuration to achieve the above-mentioned object.

(1) An image forming apparatus, including: a photosensitive drum; an LED print head arranged along a longitudinal direction of the photosensitive drum and configured to expose the photosensitive drum with light; a door arranged on one end side of the LED print head in a longitudinal direction of the LED print head and opened and closed when performing maintenance; a support portion for the LED print head, the support portion configured to operate in conjunction with opening and closing movements of the door, configured to cause the LED print head to be positioned at a first position for exposing the photosensitive drum with the light under a state in which the door is closed, and configured to cause the LED print head to be positioned at a second position more apart from the photosensitive drum than the first position under a state in which the door is open; and a guide portion formed on the door and configured to guide a cleaning member for cleaning the LED print head to the LED print head, the guide portion having a first inclined surface which is lowered toward the LED print head so that the cleaning member, which moves in the longitudinal direction of the LED print head, is continuously held in contact with the LED print head under a state in which the door is open and the LED print head is positioned at the second position.

Further features of the present invention will become apparent from the following description of exemplary embodiments with reference to the attached drawings.

DESCRIPTION OF THE EMBODIMENTS

Now, detailed description is made of embodiments of the present invention with reference to the drawings.

First Embodiment

Now, description is made of an embodiment of the present invention along the drawings.

[Configuration of Image Forming Apparatus]

Figure 1:
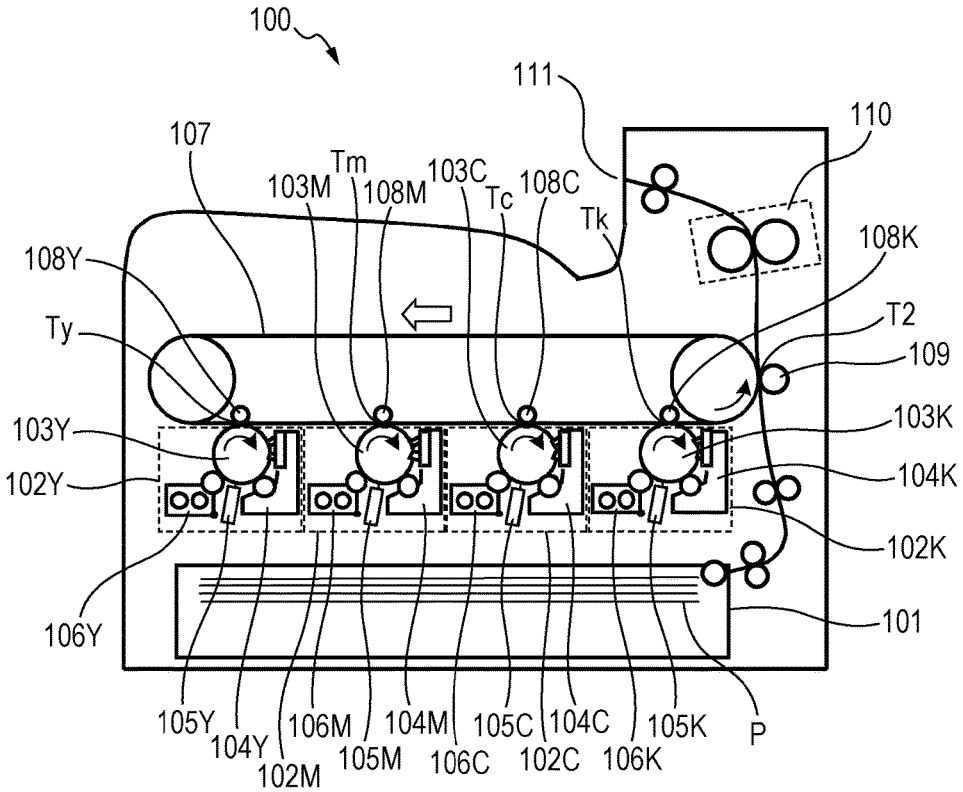
FIG. 1 is a sectional view for illustrating a schematic configuration of an image forming apparatus according to a first embodiment and a second embodiment of the present invention.

FIG. 1 is a schematic sectional view of an image forming apparatus 100 of an electrophotographic type according to a first embodiment of the present invention. The image forming apparatus 100 is an image forming apparatus of a so-called tandem type, which includes photosensitive members for respective colors including yellow (Y), magenta (M), cyan (C), and black (K) and is configured to superimpose images of the respective colors on an intermediate transfer member and collectively transfer the images onto a sheet. The image forming apparatus 100 includes a sheet-feeding unit 101, image forming portions 102Y, 102M, 102C, and 102K, an intermediate transfer belt 107, and a fixing device 110. In the following, reference symbols Y, M, C, and K denoting colors of toner are omitted unless otherwise needed.

The sheet-feeding unit 101 is configured to feed a sheet (also referred to as "recording sheet") P and convey the sheet P to a secondary transfer portion T2. The image forming portions 102Y, 102M, 102C, and 102K are configured to form toner images of yellow (Y), magenta (M), cyan (C), and black (K) on photosensitive drums 103Y, 103M, 103C, and 103K, respectively. The toner images formed on the photosensitive drums 103 of the respective image forming portions 102 are transferred onto the intermediate transfer belt 107. At the secondary transfer portion T2, the toner images on the intermediate transfer belt 107 are collectively transferred onto the sheet P fed from the sheet-feeding unit 101. The fixing device 110 is configured to fix the unfixed toner images, which are transferred to the sheet P, onto the sheet P.

The image forming portions 102Y, 102M, 102C, and 102K of the image forming apparatus according to the first embodiment have the same configuration. Therefore, in the following, description is made of the image forming portion 102Y. The image forming portion 102Y includes the photosensitive drum 103Y being a photosensitive member, a charging device 104Y configured to charge the photosensitive drum 103Y, an LED print head 105Y configured to expose the photosensitive drum 103Y with light, and a developing device 106Y configured to develop an electrostatic latent image on the photosensitive drum 103Y with use of toner. The photosensitive drum 103Y is held in contact with the intermediate transfer belt 107 to form a primary transfer portion Ty together with a primary transfer roller 108Y.

[Outline of Image Forming Process]

Description is made of an image forming process. When an image is to be formed, the charging device 104Y charges a surface of the photosensitive drum 103Y to a uniform potential. The charged surface of the photosensitive drum 103Y is exposed with light by the LED print head 105Y being an exposure unit so that the electrostatic latent image is formed. The electrostatic latent image is formed into a visible image, that is, developed with yellow toner fed by the developing device 106Y so that the toner image is formed. At the primary transfer portion Ty, the primary transfer roller 108Y is arranged so as to be opposed to the photosensitive drum 103Y. A predetermined transfer voltage is applied to the primary transfer roller 108Y. With this action, the toner image on the photosensitive drum 103Y is transferred onto the intermediate transfer belt 107. Similarly, the toner images of the other colors formed on the photosensitive drums 103M, 103C, and 103K are also transferred onto the intermediate transfer belt 107 by primary transfer rollers 108M, 108C, and 108K arranged at primary transfer portions Tm, Tc, and Tk.

At the secondary transfer portion T2, a secondary transfer roller 109 is arranged so as to be opposed to the intermediate transfer belt 107. A predetermined transfer voltage is applied to the secondary transfer roller 109. With this action, the toner images on the intermediate transfer belt 107 are transferred onto the sheet P being a recording medium conveyed from the sheet-feeding unit 101. The sheet P having the toner images transferred thereon is conveyed to the fixing device 110. The unfixed toner image is heated and fixed on the sheet P by the fixing device 110. The sheet P subjected to the fixing processing by the fixing device 110 is delivered to a sheet delivery portion 111.

[Configuration of LED Print Head]

Figure 2:
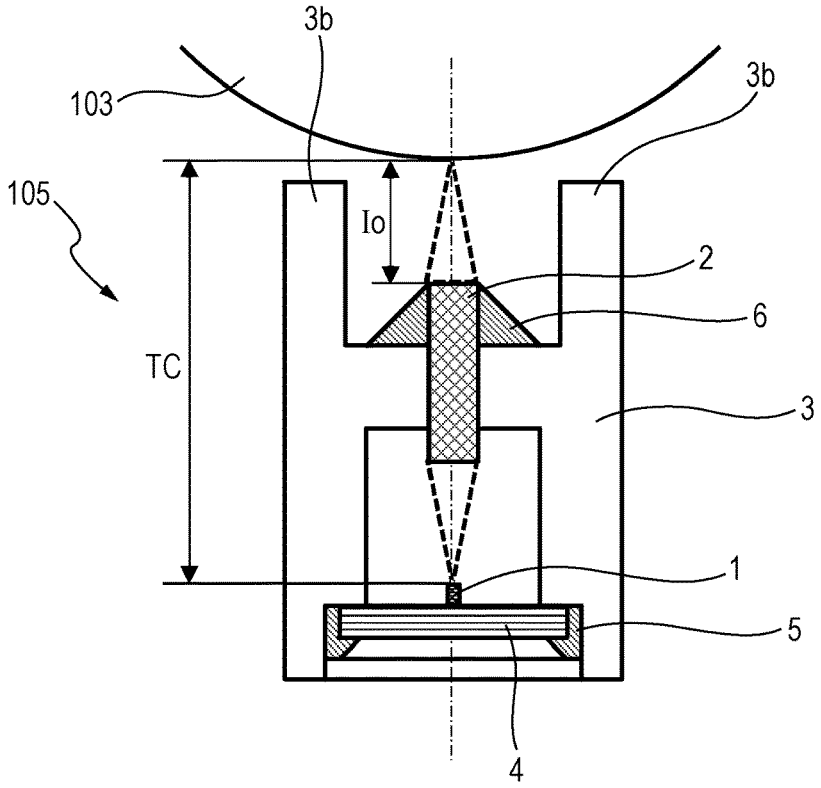
FIG. 2 is a sectional view for illustrating a configuration of an LED print head of the first embodiment and the second embodiment.

FIG. 2 is an enlarged schematic view for illustrating surroundings of the LED print head 105 of FIG. 1, and is a sectional view for illustrating a configuration of the LED print head 105 of the first embodiment. The LED print head 105 has a shape of extending in a direction parallel to an axial center of the photosensitive drum 103 (also referred to as "main scanning direction"). The LED print head 105 includes an LED array 1, a rod lens array 2 (hatched portion in FIG. 2) configured to image light (broken lines in FIG. 2) emitted from the LED array 1 on the photosensitive drum 103, and a casing 3 being a support member configured to support the LED array 1 and the rod lens array 2.

In the LED array 1 being the light emitting element, LEDs corresponding to pixels of an image to be formed are substantially linearly mounted to a board 4 in a depth direction from a near side of FIG. 2. For example, when an image having a width of 300 mm is to be depicted with a resolution of 600 dpi, the total number of LEDs is 7,000 (=300 mm×600/2.54 cm (1 inch)) or more. In the rod lens array 2, columnar lenses are arranged with regularity in the main scanning direction as in the LED array 1. It is not always necessary that the number of lenses correspond to the number of LEDs of the LED array 1. Erect equal-magnification images of the plurality of lenses are superimposed on one another to image the light emitted from the LEDs on the photosensitive drum 103. A cross section along a short direction of the casing 3, has an H-shape so that a relative distance between the board 4 having the LED array 1 mounted thereto and the rod lens array 2 arranged at a center of a cross bar in the H-shape is maintained with a predetermined accuracy. The casing 3 is manufactured with use of metal such as aluminum or with use of resin having a high rigidity. The board 4 and the rod lens array 2 are fixed to the casing 3 by an adhesive. In order to prevent dust from entering the casing 3 and adhering to the LED array 1, a boundary portion between the casing 3 and the board 4 having the LED array 1 mounted thereto is closed by a seal material 5. Similarly, a boundary portion between the casing 3 and the rod lens array 2 is closed by a seal material 6. On outer sides of the casing 3, there are provided wall portions 3*b* which are higher than the exit surface of the rod lens array 2.

[Configuration of Cleaning Member]

As illustrated in FIG. 2, an object-image distance TC of the rod lens array 2, which is a distance from the exist surface of the LED array 1 to the surface of the photosensitive drum 103, is approximately 10 mm. In this case, a distance Io from the exit surface of the rod lens array 2 to the surface of the photosensitive drum 103 is only about 3 mm. Therefore, the distance between the photosensitive drum 103 and the rod lens array 2 is extremely small. In a periphery of the surface of the photosensitive drum 103, part of toner fed by the developing device 106 is not transferred to the photosensitive drum 103, that is, does not adhere to the photosensitive drum 103, and may fly in the atmosphere as dispersed toner. Therefore, when the image forming apparatus 100 is operated continuously for a long period of time, the dispersed toner may partially adhere to the exit surface of the rod lens array 2. When image formation is performed in such a circumstance, the light from the exit surface of the rod lens array 2 to which the toner adheres is blocked, with the result that an electrostatic latent image is prevented from being formed on the photosensitive drum 103. Therefore, a uniform image density is not obtained, with the result that image defects such as streaks and density unevenness may occur.

Figure 3:
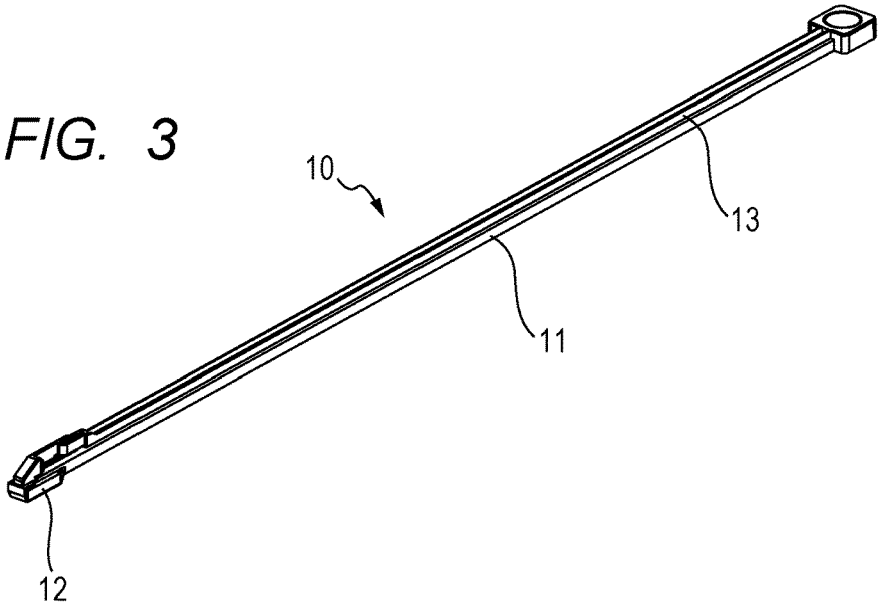
FIG. 3 is a perspective view for illustrating a configuration of a cleaning member of the first embodiment and the second embodiment.

In order to avoid such a situation, a cleaning member configured to wipe off the toner adhering to the rod lens array 2 of the LED print head 105 is prepared. FIG. 3 is a perspective view for illustrating a configuration of a cleaning member 10 of the first embodiment. The cleaning member 10 is a member having a configuration in which anon-woven fabric 12 configured to wipe off dirt from the surface of the rod lens array 2 is fixed to a distal end of a handle portion 11 being a rod-like part made of soft resin such as polypropylene. The handle portion 11 has a protruding portion 13 having a reverse T-shaped cross section. This cross-sectional shape enables insertion of the cleaning member 10 into a groove portion 250*g* of a guide portion 250*a* (see FIG. 5) provided to an inner door 250 (see FIG. 5) which is opened and closed at the time of maintenance work for the image forming apparatus 100. As a result, the cleaning member 10 can easily be inserted into the groove portion 250*g* and can stably move in the groove portion 250*g*. A user or a service worker can open the inner door 250 provided to a front surface (near side in FIG. 1) of the casing of the image forming apparatus 100 and clean the rod lens array 2 of the LED print head 105 with use of the cleaning member 10.

[Slide Mechanism for LED Exposure Unit]

Figure 4:
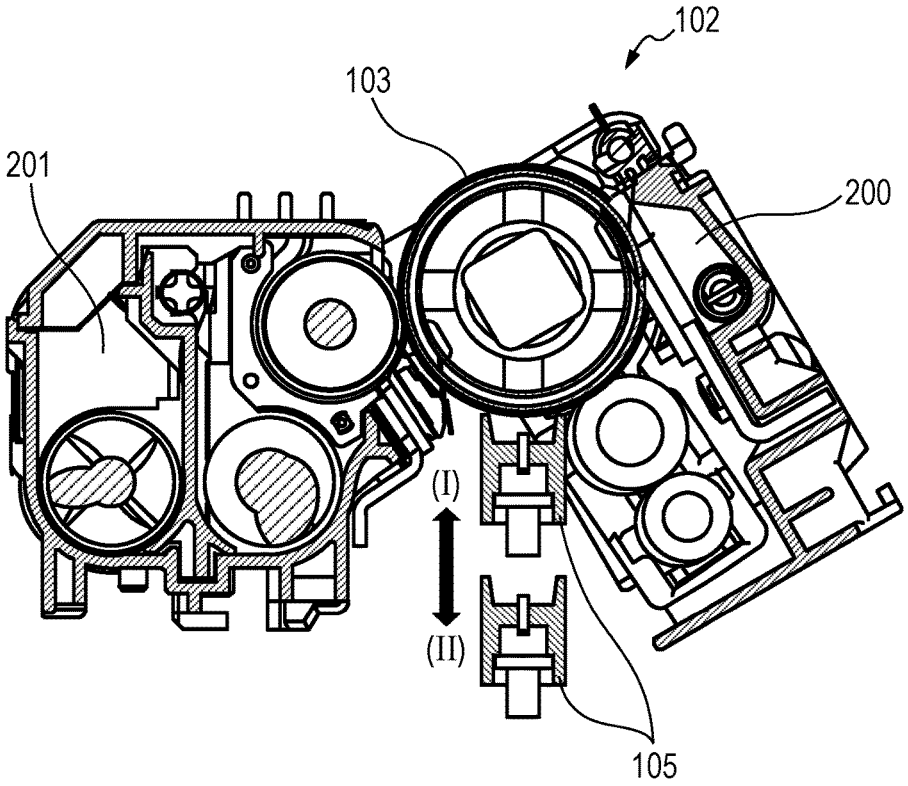
FIG. 4 is a view for illustrating arrangement positions of the LED print head of the first embodiment and the second embodiment.
Figure 5:
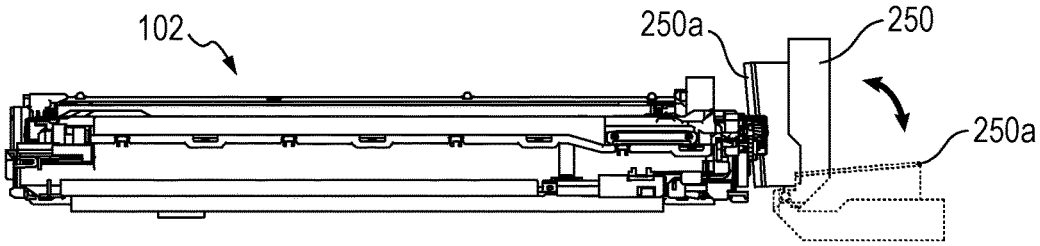
FIG. 5 is a view for illustrating a positional relationship between an image forming portion and an inner door of the first embodiment and the second embodiment.

FIG. 4 is a view for illustrating arrangement positions of the LED print head 105, and is an enlarged sectional view of the image forming portion 102 of the image forming apparatus 100 according to the first embodiment. In FIG. 4, the photosensitive drum 103 and the charging device 104, which are described with reference to FIG. 1, are integrated in a drum cartridge 200. A developing unit 201 is a unit which is the same as the developing device 106. The arrangement positions of the LED print head 105 include a position (I) being a first position close to the photosensitive drum 103 and a position (II) being a second position apart from the photosensitive drum 103. Under a state in which the inner door 250 is closed, that is, when an image forming operation is performed, the LED print head 105 is arranged at the position (I) and forms an electrostatic latent image on the photosensitive drum 103 in accordance with an image signal. When the LED print head 105 is arranged at the position (I) at the time of maintenance work such as unit replacement, the drum cartridge 200 is caught by the LED print head 105 and cannot be drawn out. Therefore, the image forming portion 102 includes a slide mechanism configured to cause the LED print head 105 to move from the position (I) to the position (II) when the inner door 250 is opened at the time of maintenance work or the like. FIG. 5 is a view for illustrating a positional relationship between the image forming portion 102 and the inner door 250 which is opened and closed at the time of maintenance. FIG. 5 is an illustration of the positional relationship when the image forming portion 102 is viewed from a left side in FIG. 1. The arrows of FIG. 5 indicate directions in which the inner door 250 can be opened and closed through an opening and closing operation. In FIG. 5, a standing state of the inner door 250 indicates the closed state of the inner door 250 with the solid lines, and a lying state of the inner door 250 indicates the open state of the inner door 250 with the broken lines. In the first embodiment, the drum cartridge 200 cannot be drawn out unless the inner door 250 provided at the position opposed to the image forming portion 102 as illustrated in FIG. 5 is opened. As described above, the LED print head 105 moves to the position (I) being an exposure position under the state in which the inner door 250 is being closed, and the LED print head 105 moves to the position (II) being a retreated position under the state in which the inner door 250 is being opened. The LED print head 105 can reciprocate between the two positions in conjunction with the opening and closing movements of the inner door 250. The inner door 250 is provided at the position opposed to the image forming portion 102 for each image forming portion 102.

Figure 6A:
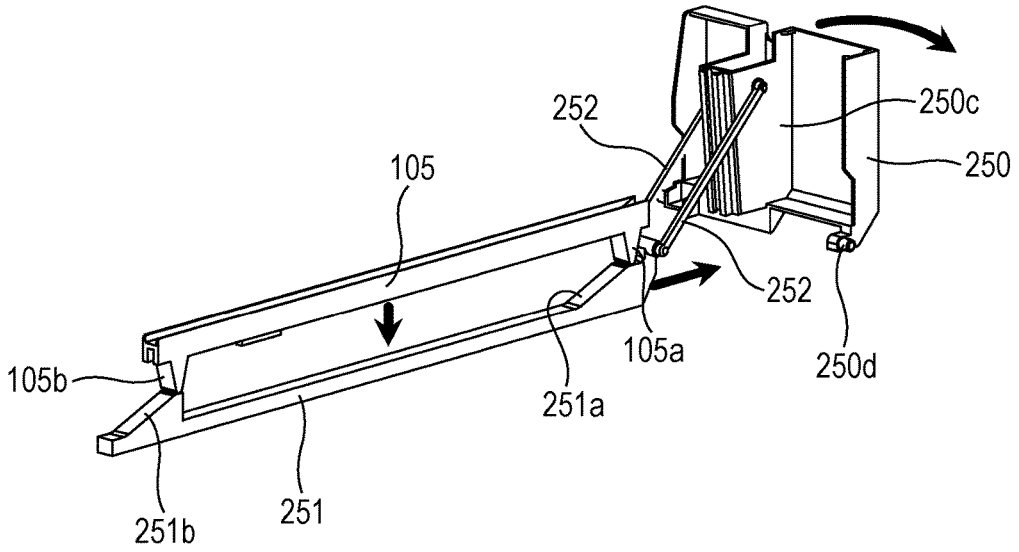
FIG. 6A is a view for illustrating a slide mechanism for the LED print head of the first embodiment and the second embodiment under a state in which the inner door is closed.
Figure 6B:
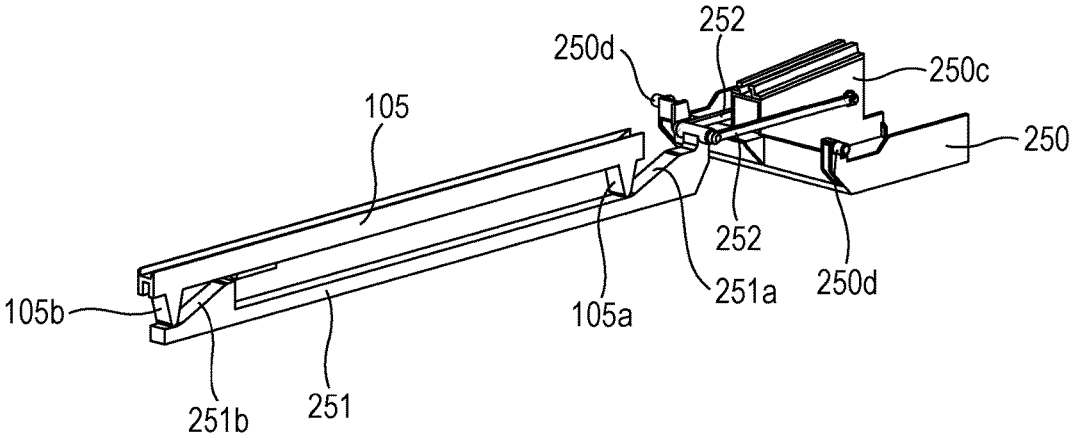
FIG. 6B is a view for illustrating the slide mechanism for the LED print head of the first embodiment and the second embodiment under a state in which the inner door is open.

FIG. 6A and FIG. 6B are perspective views for illustrating a mechanism of the slide mechanism configured to cause the LED print head 105 to reciprocate between the position (I) and the position (II). FIG. 6A is a perspective view for illustrating a state of the LED print head 105 under the state in which the inner door 250 is closed. FIG. 6B is a perspective view for illustrating a state of the LED print head 105 under the state in which the inner door 250 is open. On a back side of the inner door 250, which is a side opposed to the LED print head 105 under the state in which the inner door 250 is closed, there is provided a standing wall 250*c* being a standing wall portion which stands on the inner door 250. The standing wall 250*c* and an end portion of a lifter 251, which constructs the slide mechanism configured to cause the LED print head 105 to reciprocate between the position (I) and the position (II), on the inner door 250 side are connected to each other by links 252 being a pair of connection rods. The lifter 251 being a support portion for the LED print head 105 has slopes being two inclined surfaces. The two inclined surfaces include a slope 251*a* formed in a front portion (side close to the inner door 250) of the lifter 251 in the longitudinal direction, and a slope 251*b* formed in a rear portion (side apart from the inner door 250) of the lifter 251 in the longitudinal direction. The LED print head 105 placed on the lifter 251 moves along the inclined surfaces while being held in abutment against the slopes 251*a* and 251*b* of the lifter 251. Therefore, the LED print head 105 has leg portions 105*a* and 105*b* for reciprocation between the position (I) and the position (II).

FIG. 6A is an illustration of the state in which the inner door 250 is closed, that is, the state in which the inner door 250 stands. At this time, the LED print head 105 is in the state of being arranged at the position (I) of FIG. 4. When the inner door 250 is opened, that is, moved in the arrow direction from the state in which the inner door 250 is closed, that is, from the state in which the inner door 250 stands, the inner door 250 is rotated in the arrow direction about a pair of projection portions 250*d* as rotation centers. Along with this action, the lifter 251 moves in the arrow direction through intermediation of the links 252 connected to the standing wall 250*c* of the inner door 250. When the lifter 251 moves in the arrow direction, the leg portions 105*a* and 105*b* of the LED print head 105 placed on the lifter 251 move along the inclined surfaces of the slopes 251*a* and 251*b* of the lifter 251. Then, the LED print head 105 is lowered in the arrow direction. FIG. 6B is an illustration of a state in which the leg portions 105*a* and 105*b* of the LED print head 105 are completely lowered along the inclined surfaces of the slopes 251*a* and 251*b* of the lifter 251. At this time, the LED print head 105 is in the state of being arranged at the position (II) of FIG. 4.

When the inner door 250 is closed from the open state illustrated in FIG. 6B, the lifter 251 moves in a direction reverse to the arrow direction of FIG. 6A, that is, in a direction of separating from the inner door 250 through intermediation of the links 252 connected to the inner door 250. With this action, the leg portions 105*a* and 105*b* of the LED print head 105 move in an upward direction in FIG. 6B along the inclined surfaces of the slopes 251*a* and 251*b* of the lifter 251. Then, the LED print head 105 is raised and shifted to the state of being arranged at the position (I) of FIG. 4.

Figure 7A:
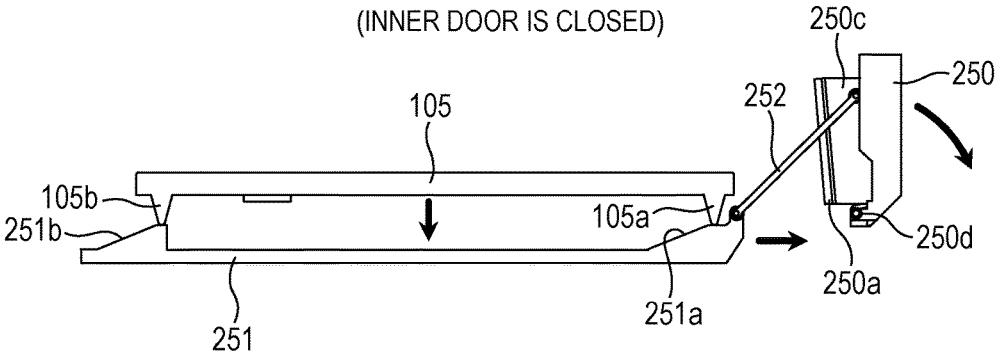
FIG. 7A is a view for illustrating the slide mechanism for the LED print head of the first embodiment and the second embodiment under the state in which the inner door is closed.
Figure 7B:
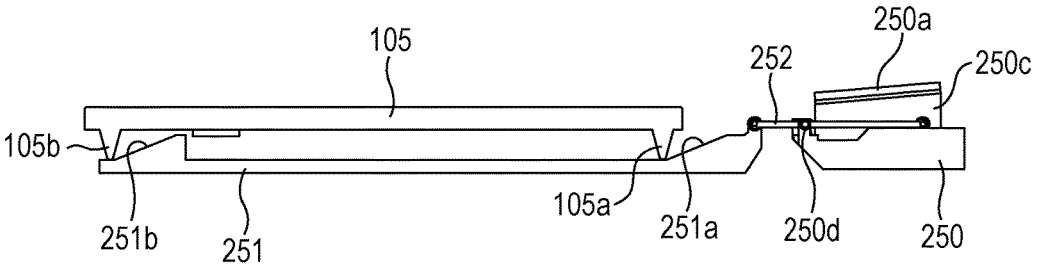
FIG. 7B is a view for illustrating the slide mechanism for the LED print head of the first embodiment and the second embodiment under a state in which the inner door is open.

FIG. 7A and FIG. 7B are side views for illustrating states of the LED print head 105 and the inner door 250 when the states of the perspective views of FIG. 6A and FIG. 6B are viewed from the left side in FIG. 1. FIG. 7A corresponds to FIG. 6A, and FIG. 7B corresponds to FIG. 6B. Movements of the LED print head 105 and the lifter 251 during the opening and closing operations of the inner door 250 are the same as those described with reference to FIG. 6A and FIG. 6B, and hence description thereof is omitted. The reciprocation mechanism for the LED print head 105 is not limited to the mechanical link mechanism illustrated in FIG. 6A, FIG. 6B, FIG. 7A, and FIG. 7B. The reciprocation mechanism may be, for example, an electrical mechanism, which includes an opening and closing detection sensor at the inner door 250 and is configured to raise and lower the LED print head 105 with power of a motor or the like.

[Posture Control for Cleaning Member]

When the LED print head 105 is arranged at the position (I) (see FIG. 4) being the arrangement for image formation (image forming), a distance between the photosensitive drum 103 and the LED print head 105 is only about 3 mm, and there is no space for allowing insertion of the cleaning member 10. When the cleaning member 10 is forcibly inserted, the cleaning member 10 is brought into contact with the photosensitive drum 103, with the result that the photosensitive drum 103 may be damaged. Therefore, the LED print head 105 is cleaned when the LED print head 105 is arranged at the position (II) in the retreated state. Typically, a guide portion configured to bring the cleaning member 10 into abutment against the rod lens array 2 at the time of cleaning is required. However, before the LED print head 105 retreats to the position (II), there is a space of only 3 mm between the LED print head 105 and the photosensitive drum 103 at the time of image forming. Therefore, such a space is too narrow to provide the guide portion for the cleaning member 10 in the vicinity of the rod lens array 2 of the LED print head 105.

[Shape of Guide Portion]

Figure 8A:
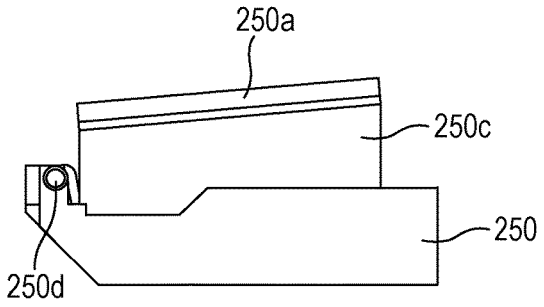
FIG. 8A is a side view for illustrating a configuration of a guide portion of the first embodiment.
Figure 8B:
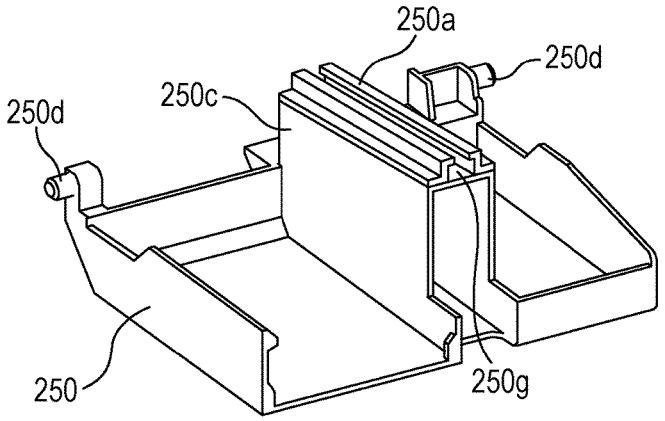
FIG. 8B is a perspective view for illustrating a configuration of the guide portion of the first embodiment.

Therefore, in the first embodiment, the guide portion 250*a* is provided on an inner side of the inner door 250, that is, on a side opposed to the LED print head 105. The guide portion 250*a* is a guide portion configured to regulate posture of the cleaning member 10, which moves in the longitudinal direction of the LED print head, to reliably clean the rod lens array 2 of the LED print head 105. FIG. 8A and FIG. 8B are illustrations of a shape of the guide portion 250*a* provided to the inner door 250. FIG. 8A and FIG. 8B are illustrations of a state of the inner door 250 when the cleaning member 10 is used, that is, a state of the inner door 250 when the LED print head 105 is arranged at the position (II). In FIG. 8A and FIG. 8B, the links 252 are omitted.

The side view illustrated in FIG. 8A is an illustration of a state of the inner door 250 as viewed from the left side in FIG. 1. The guide portion 250*a* is provided at a head top portion of the standing wall 250*c* which stands on the inner door 250. As illustrated in FIG. 8A, the guide portion 250*a* has a slope shape (first inclined surface) being inclined in a downward direction toward the LED print head 105. An angle of the slope of the guide portion 250*a* is set so that the non-woven fabric 12 provided at a distal end of the cleaning member 10 is brought into abutment against the casing 3 of the LED print head 105 when the cleaning member 10 inserted into the groove portion 250*g* of the guide portion 250*a* proceeds along the shape of the groove portion 250*g*. As illustrated in FIG. 8B, the groove portion 250*g* having a reverse T-shaped cross section is formed in the guide portion 250*a*. The cleaning member 10 is oriented obliquely in the downward direction and inserted into the groove portion 250*g* of the guide portion 250*a*, and then is pushed. Accordingly, the cleaning member 10 proceeds along the groove portion 250*g* of the guide portion 250*a*. Therefore, deviation of the cleaning member 10 in upward, downward, rightward, and leftward directions is regulated by the groove portion 250*g*. As a result, the movement of the cleaning member 10 is stabilized, thereby being capable of allowing the cleaning member 10 to proceed in the direction toward the LED print head 105 without deviation.

Figure 9:
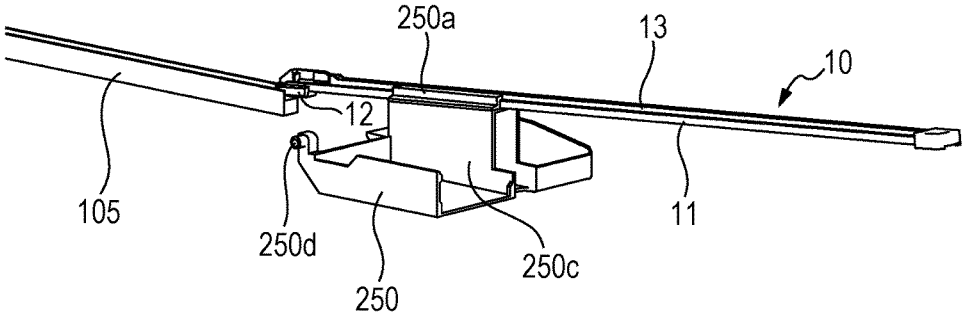
FIG. 9 is a view for illustrating a movement of the cleaning member of the first embodiment.

FIG. 9 is a perspective view for illustrating a state in which the cleaning member 10 inserted into the groove portion 250*g* of the guide portion 250*a* reaches an end portion of the LED print head 105 on the inner door 250 side. In FIG. 9, the links 252 are omitted. As illustrated in FIG. 9, the cleaning member 10 is inserted into the groove portion 250*g* of the guide portion 250*a*, and the handle portion 11 of the cleaning member 10 is pushed in the direction toward the LED print head 105. With this action, the cleaning member 10 moves in the direction toward the LED print head 105 along the slope of the guide portion 250*a*. As a result, the cleaning member 10 is guided to the LED print head 105 by the groove portion 250*g* of the guide portion 250*a*. Then, the non-woven fabric 12 provided at the distal end of the cleaning member 10 is brought into abutment against the LED print head 105. The handle portion 11 of the cleaning member 10 has a reverse T-shaped cross section, and is inserted into the groove portion 250*g*, which has the reverse T-shaped cross section, of the guide portion 250*a*. Thus, the handle portion 11 is regulated by the shape of the groove portion 250*g*. With this configuration, the cleaning 10 is guided in the direction toward the LED print head 105 without deviation in the upward, downward, rightward, and leftward directions.

Figure 10A:
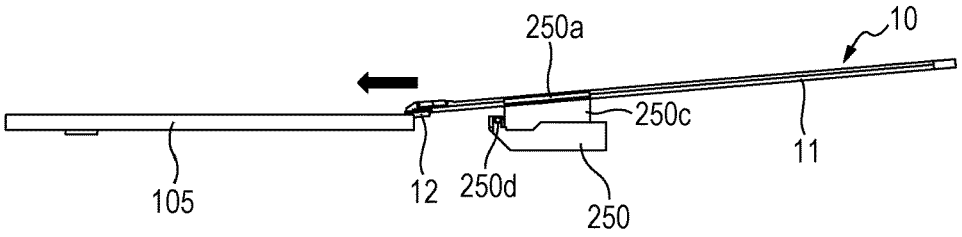
FIG. 10A is a side view for illustrating a movement of the cleaning member of the first embodiment.
Figure 10B:
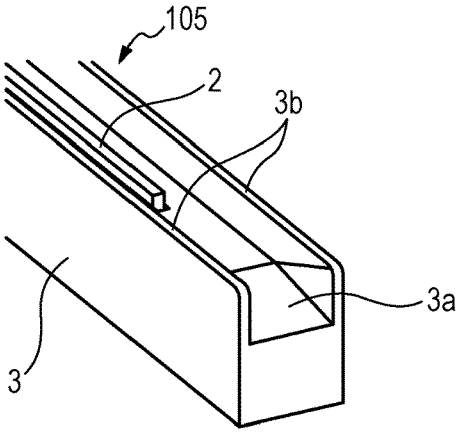
FIG. 10B is a view for illustrating a configuration of the LED print head of the first embodiment.

FIG. 10A is a side view for illustrating a state of the cleaning member 10 illustrated in FIG. 9 as viewed from the left side in FIG. 1. FIG. 10B is an enlarged view for illustrating surroundings of an end portion of the casing 3 of the LED print head 105 on the inner door 250 side against which the non-woven fabric 12 of the cleaning member 10 is held in abutment in FIG. 10A. A guide slope 3*a* is provided at an end portion of the casing 3 of the LED print head 105 on the inner door 250 side (door side). The guide slope 3*a* has an inclined surface, which is inclined in the upward direction in FIG. 10B toward the rod lens array 2 and is configured to guide the non-woven fabric 12 of the cleaning member 10 to the rod lens array 2. The guide slope 3*a* causes the non-woven fabric 12 provided at the distal end of the cleaning member 10 to be raised in the upward direction in FIG. 10A. With this action, the cleaning member 10 is urged in the downward direction in FIG. 10A, that is, in the direction toward the LED print head 105. Wall portions 3*b* are provided to the casing 3. The non-woven fabric 12 of the cleaning member 10 is regulated by the wall portions 3*b* in the rightward-and-leftward direction (horizontal direction) in FIG. 10B, which is orthogonal to a proceeding direction of the cleaning member 10. With this action, deviation of the cleaning member 10 in the horizontal direction is prevented.

Figure 10C:
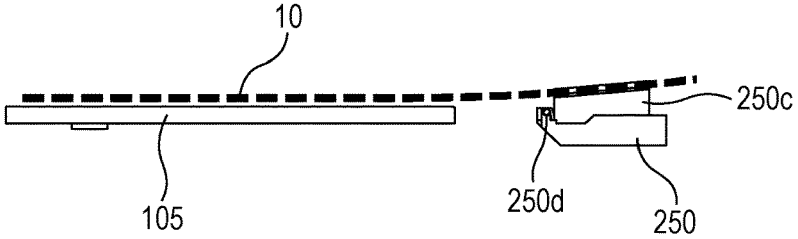
FIG. 10C is a side view for illustrating a movement of the cleaning member of the first embodiment.

FIG. 10C is an illustration of a state in which the cleaning member 10 is further inserted in the direction toward the LED print head 105 from the state of FIG. 10A. The portion indicated by the broken line corresponds to the cleaning member 10. As illustrated in FIG. 10C, when the non-woven fabric 12 of the cleaning member 10 is held in abutment against the rod lens array 2 of the LED print head 105 to clean the rod lens array 2, the cleaning member 10 is entirely warped in the downward direction in FIG. 10C. That is, fluttering of the cleaning member 10 in the upward-and-downward direction is regulated by the guide portion 250*a* of the inner door 250, and the cleaning member 10 is raised in the upward direction by the guide slope 3*a* of the casing 3. With this action, the cleaning member 10 is entirely urged in the downward direction in FIG. 10C. As a result, the non-woven fabric 12 provided at the distal end of the cleaning member 10 is also urged in the downward direction in FIG. 10C, that is, in the direction toward the rod lens array 2. Therefore, the surface of the rod lens array 2 can reliably be wiped. A force of urging the non-woven fabric 12 in the direction toward the rod lens array 2 is larger than a force of urging the handle portion 11 in the direction toward the rod lens array 2. The non-woven fabric 12 of the cleaning member 10 is guided between the wall portions 3*b* provided on both sides of the casing 3. Therefore, the non-woven fabric 12 can reciprocate on the surface of the rod lens array 2 while reliably cleaning the rod lens array 2 without being separated from the rod lens array 2.

As described above, according to the first embodiment, the cleaning member is capable of reliably cleaning the LED print head without providing the guide portion for the cleaning member to the LED print head.

Second Embodiment

In the first embodiment, the shape of the guide portion 250*a* provided to the inner door 250 is set so as to allow the cleaning member 10 to be inserted obliquely from the upper side to the lower side. In the second embodiment, description is made of a shape of the guide portion which enables the LED print head 105 to be reliably cleaned by only causing the cleaning member 10 to reciprocate in the horizontal direction without need of being aware of the angle of insertion of the cleaning member 10.

[Shape of Guide Portion]

Figure 11A:
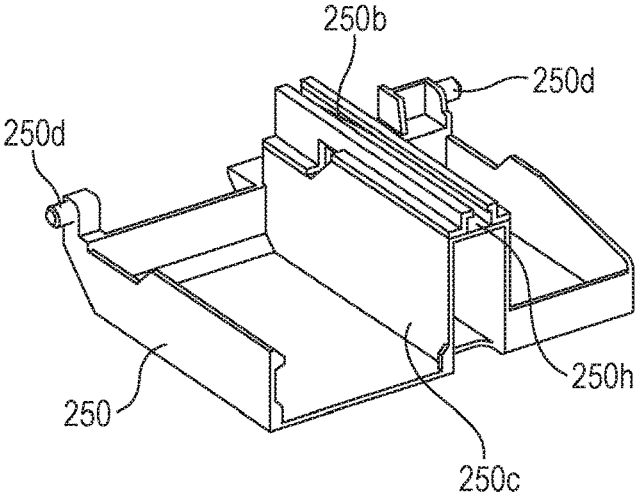
FIG. 11A is a view for illustrating a configuration of a guide portion of the second embodiment.
Figure 11B:
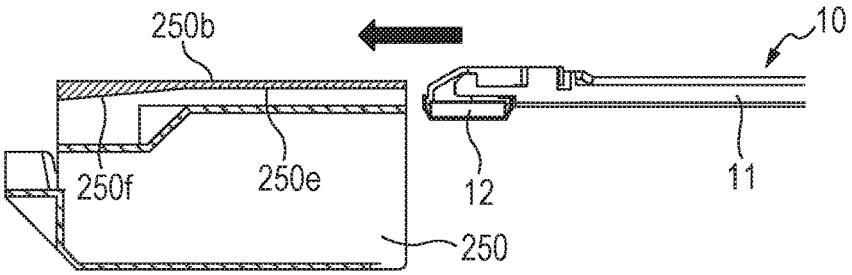
FIG. 11B is a sectional view for illustrating a movement of the cleaning member of the second embodiment.
Figure 11C:
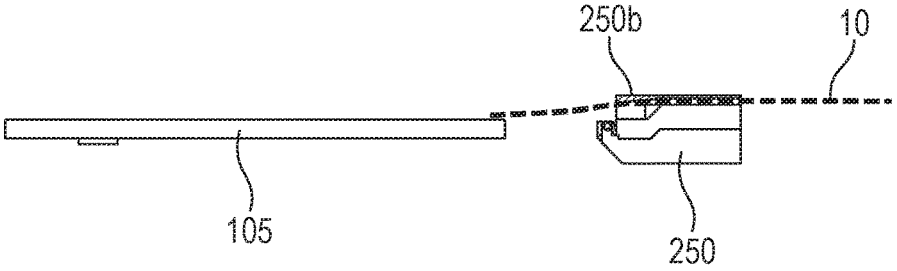
FIG. 11C is a side view for illustrating a movement of the cleaning member of the second embodiment.

FIG. 11A is a perspective view for illustrating a shape of a guide portion 250*b* provided to the inner door 250 of the second embodiment. FIG. 11B is a sectional view of the inner door 250 including the guide portion 250*b* as viewed from the left side in FIG. 1. In FIG. 11A, FIG. 11B, and FIG. 11C, the links 252 are omitted. As illustrated in FIG. 11A, similarly to the guide portion 250*a* of the first embodiment, the guide portion 250*b* is provided at a head top portion of the standing wall 250*c* which stands on the inner door 250. Further, similarly to the first embodiment, a groove portion 250*h* having a reverse T-shaped cross section is formed in the guide portion 250*b*. When the LED print head 105 is to be cleaned, the cleaning member 10 is inserted into the groove portion 250*h*.

As illustrated in FIG. 11B, the guide portion 250*b* has a horizontal portion 250*e* being a horizontal surface and a slope portion 250*f* (first inclined surface) being an inclined surface connected to the horizontal portion 250*e*. As indicated by the arrow in FIG. 11B, the direction of inserting the cleaning member 10 toward an inlet side of the guide portion 250*b* is a horizontal direction, which is different from the oblique direction of the first embodiment. Therefore, the non-woven fabric 12 provided at the distal end of the cleaning member 10 is inserted into the guide portion 250*b* in the horizontal direction and proceeds under the horizontal portion 250*e*. The slope portion 250*f* being continuous from the horizontal portion 250*e* has an inclination which causes the distal end of the cleaning member 10 to be oriented in the downward direction. This inclination has an angle which causes the non-woven fabric 12, which proceeds under the slope portion 250*f*, to be brought into abutment against the guide slope 3*a* (second inclined surface) of the casing 3 of the LED print head 105. A distance between a position at which the distal end of the cleaning member 10 is oriented in the downward direction and a position of the casing 3 of the LED print head 105 is smaller than that of the first embodiment. Therefore, the angle of inclination of the slope portion 250*f* is larger than the angle of inclination of the guide portion 250*a* of the first embodiment.

FIG. 11C is a side view for illustrating a state in which the cleaning member 10, which is inserted into the groove portion 250*h* of the guide portion 250*b*, reaches the guide slope 3*a* of the casing 3 of the LED print head 105. The portion indicated by the broken line corresponds to the cleaning member 10. As illustrated in FIG. 11C, the cleaning member 10 which proceeds in the groove portion 250*h* of the guide portion 250*b* is deformed into a substantially S-shape and is brought into abutment against the LED print head 105. Also in the second embodiment, fluttering of the cleaning member 10 in the upward-and-downward direction is regulated by the guide portion 250*b* of the inner door 250, and the cleaning member 10 is raised in the upward direction by the guide slope 3*a* of the casing 3. With this action, the cleaning member 10 is entirely urged in the downward direction in FIG. 11C. In particular, in the second embodiment, the inclination of the slope portion 250*f* of the guide portion 250*b* is larger than the inclination of the guide portion 250*a* of the first embodiment. Therefore, the force of urging the cleaning member 10 is larger than that of the first embodiment. As a result, the non-woven fabric 12 provided at the distal end of the cleaning member 10 is also urged in the downward direction in FIG. 11C, that is, in the direction toward the rod lens array 2. Therefore, the surface of the rod lens array 2 can reliably be wiped. The non-woven fabric 12 of the cleaning member 10 is guided between the wall portions 3*b* provided on both the sides of the casing 3. Therefore, the non-woven fabric 12 can reciprocate on the surface of the rod lens array 2 while reliably cleaning the rod lens array 2 without being separated from the rod lens array 2. As a result, a user or a service worker can clean the rod lens array 2 of the LED print head 105 by only causing the cleaning member 10 to reciprocate in the horizontal direction without need of being aware of the angle of insertion of the cleaning member 10.

As described above, according to the second embodiment, the cleaning member is capable of reliably cleaning the LED print head without providing the guide portion for the cleaning member to the LED print head.

[Effect of Invention]

According to the present invention, the cleaning member is capable of reliably cleaning the LED print head without providing the guide portion for the cleaning member to the LED print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-196480, filed Oct. 4, 2016, which is hereby incorporated by reference herein in its entirety.

What is claimed is:

1. An image forming apparatus comprising:

a photosensitive drum configured to be rotatable relative to a main body of the image forming apparatus;

an LED print head having a plurality of light emitting elements so as to expose the photosensitive drum to light emitted from the plurality of light emitting elements, the LED print head also having a lens configured to image the light emitted from the plurality of light emitting elements on the photosensitive drum;

a door disposed upstream of the LED print head in a direction from one end side of the LED print head in a longitudinal direction of the LED print head toward another end side of the LED print head in the longitudinal direction and configured to be openable and closable with respect to the main body;

a support portion configured to support the LED print head so as to move the LED print head between a first position and a second position in conjunction with opening and closing movements of the door, so that the LED print head is positioned at the first position for exposing the photosensitive drum with the light under a state in which the door is closed, and the LED print head is positioned at the second position more apart from the photosensitive drum than the first position under a state in which the door is open; and a guide portion provided on a back side of the door and configured to allow a cleaning member for cleaning an exit surface of the lens to be inserted into the guide portion in a direction of insertion under the state in which the door is open, the guide portion being configured to abut against the cleaning member in a perpendicular direction perpendicular to the direction of insertion to regulate a movement of the cleaning member in the perpendicular direction and the guide portion being configured to guide a movement of the cleaning member in the direction of insertion, wherein the guide portion has a contact portion configured to contact the cleaning member inserted into the guide portion, and the contact portion being inclined toward the exit surface of the lens in an optical axis direction of the lens as the contact portion becomes closer to the LED print head in the longitudinal direction so that the cleaning member keeps contacting the exit surface of the lens.

2. An image forming apparatus according to claim 1, wherein the LED print head exposes the photosensitive drum to the light from below in a vertical direction.

3. An image forming apparatus according to claim 2, wherein an extended line of the inclined contact portion intersects with the one end side of the LED print head in the longitudinal direction.

4. An image forming apparatus according to claim 2, wherein a standing wall portion which includes the guide portion is formed on the door, wherein an end portion of the support portion and an end portion of the standing wall portion of the door are connected to each other through intermediation of a connection rod which is connected to the support portion and the standing wall portion, wherein the support portion has an inclined surface along which the LED print head placed on the support portion moves, wherein, when the door is opened from the state in which the door is closed, the support portion moves in a direction of approaching the door so that the LED print head placed on the support portion is lowered from the first position along the inclined surface of the support portion to move to the second position, and wherein, when the door is closed from the state in which the door is open, the support portion moves in a direction of separating from the door so that the LED print head placed on the support portion is raised from the second position along the inclined surface of the support portion to move to the first position.

5. An image forming apparatus according to claim 2, wherein the guide portion has a groove portion into which the cleaning member is inserted, wherein the groove portion has an inclined surface, and wherein a distal end of the cleaning member proceeds in the groove portion along the inclined surface of the groove portion to be brought into contact with the exit surface on the one end side of the LED print head in the longitudinal direction.

6. An image forming apparatus according to claim 5, wherein the cleaning member includes a handle portion and a non-woven fabric portion which is arranged at a distal end of the handle portion and is configured to wipe off dirt on the LED print head, wherein a cross section of the groove portion taken along a direction perpendicular to a direction in which the groove portion extends has a reverse T-shaped cross section, and wherein a cross section of the handle portion of the cleaning member taken along a direction perpendicular to a direction in which the handle portion extends has a reverse T-shaped cross section to enable insertion into the groove portion.

7. An image forming apparatus according to claim 6, wherein the LED print head comprises:

a board configured to have the plurality of light emitting elements; and a holding member configured to hold the board and the lens, wherein the holding member has an inclined surface formed at the one end side of the LED print head in the longitudinal direction, the inclined surface being a surface to which the non-woven fabric portion of the cleaning member guided by the guide portion is contacted, and which is configured to guide the non-woven fabric portion to the lens, and wherein the inclined surface of the holding member is inclined toward the exit surface as the inclined surface goes from one end side of the holding member toward another end side of the holding member in the longitudinal direction.

8. An image forming apparatus according to claim 7, wherein the holding member has wall portions, which extend toward the photosensitive drum, on both sides of the lens in a shorter direction of the holding member, and which are configured to regulate deviation of the cleaning member in the short direction.

9. An image forming apparatus comprising:

a photosensitive drum configured to be rotatable relative to a main body of the image forming apparatus;

an LED print head having a plurality of light emitting elements so as to expose the photosensitive drum to light emitted from the plurality of light emitting elements, the LED print head also having a lens configured to image the light emitted from the plurality of light emitting elements on the photosensitive drum, wherein the LED print head exposes the photosensitive drum to the light from below in a vertical direction; and a guide portion provided to the main body of the image forming apparatus and disposed upstream of the LED print head in a direction from one end side of the LED print head in a longitudinal direction of the LED print head toward another end side of the LED print head in the longitudinal direction, and the guide portion being configured to guide a movement of a cleaning member for cleaning an exit surface of the lens, the cleaning member being inserted from outside of the main body of the image forming apparatus, wherein the guide portion is configured to guide the movement of the cleaning member so that a movement direction of the cleaning member from when a downstream end of the cleaning member inserted in an insertion direction leaves the guide portion to when the downstream end contacts the exit surface of the lens intersects with the exit surface of the lens, wherein the guide portion has a first restricting portion configured to restrict the cleaning member inserted from moving in a direction away from the exit surface of the lens in an optical axis direction of the lens, an extended line of the first restricting portion being inclined such that the extended line intersects with the exit surface of the lens.

10. An image forming apparatus according to claim 9, wherein the guide portion has a second restricting portion configured to restrict the cleaning member inserted from moving in a direction perpendicular to both the optical axis direction of the lens and the insertion direction, and wherein in the insertion direction, the first restricting portion is located downstream of the second restricting portion.

11. An image forming apparatus according to claim 9, wherein the first restricting portion comprises a surface which the cleaning member, inserted in the main body of the image forming apparatus and moving in the insertion direction, contacts.

12. An image forming apparatus according to claim 9, wherein in the vertical direction, the first restricting portion is located above a movement route of the cleaning member inserted into the guide portion.

13. An image forming apparatus comprising:

a photosensitive drum configured to be rotatable relative to a main body of the image forming apparatus;

an LED print head having a plurality of light emitting elements so as to expose the photosensitive drum to light emitted from the plurality of light emitting elements, the LED print head also having a lens configured to image the light emitted from the plurality of light emitting elements on the photosensitive drum, wherein the LED print head exposes the photosensitive drum to the light from below in a vertical direction; and a guide portion provided to the main body of the image forming apparatus and disposed upstream of the LED print head in a direction from one end side of the LED print head in a longitudinal direction of the LED print head toward another end side of the LED print head in the longitudinal direction, and the guide portion being configured to guide a movement of a cleaning member for cleaning an exit surface of the lens, the cleaning member being inserted from outside of the main body of the image forming apparatus, wherein the guide portion is configured to guide the movement of the cleaning member so that a movement direction of the cleaning member from when a downstream end of the cleaning member inserted in an insertion direction leaves the guide portion to when the downstream end contacts the exit surface of the lens intersects with the exit surface of the lens, wherein the guide portion has a groove portion into which the cleaning member is inserted, wherein the groove portion has an inclined surface, and wherein a distal end of the cleaning member proceeds in the groove portion along the inclined surface of the groove portion to be brought into contact with the exit surface on the one end side of the LED print head in the longitudinal direction.

14. An image forming apparatus according to claim 13, wherein the cleaning member includes a handle portion and a non-woven fabric portion which is arranged at a distal end of the handle portion and is configured to wipe off dirt on the LED print head, wherein a cross section of the groove portion taken along a direction perpendicular to a direction in which the groove portion extends has a reverse T-shaped cross section, and wherein a cross section of the handle portion of the cleaning member taken along a direction perpendicular to a direction in which the handle portion extends has a reverse T-shaped cross section to enable insertion into the groove portion.

15. An image forming apparatus according to claim 14, wherein the LED print head comprises:

a board configured to have the plurality of light emitting elements; and a holding member configured to hold the board and the lens, wherein the holding member has an inclined surface formed at the one end side of the LED print head in the longitudinal direction, the inclined surface being a surface to which the non-woven fabric portion of the cleaning member guided by the guide portion is contacted, and which is configured to guide the non-woven fabric portion to the lens, and wherein the inclined surface of the holding member is inclined toward the exit surface as the inclined surface goes from one end side of the holding member toward another end side of the holding member in the longitudinal direction.

16. An image forming apparatus according to claim 15, wherein the holding member has wall portions, which extend toward the photosensitive drum, on both sides of the lens in a shorter direction of the holding member, and which are configured to regulate deviation of the cleaning member in the short direction.

* * * * *